United States Patent [19]

Sassenberg

[11] Patent Number: 4,944,458

[45] Date of Patent: Jul. 31, 1990

[54] SPRAY CAN NOZZLE PROTECTOR

[76] Inventor: Richard Sassenberg, 180 E. Prospect Ave., Mamaroneck, N.Y. 10543

[21] Appl. No.: 302,922

[22] Filed: Jan. 30, 1989

[51] Int. Cl.[5] ..... B65P 1/04

[52] U.S. Cl. ..... 239/288.5; 222/542; 222/545; 222/553

[58] Field of Search ..... 239/337, 288, 288.3, 239/104; 222/542, 545, 553

[56] References Cited

U.S. PATENT DOCUMENTS

| | | | |
|---|---|---|---|
| 2,112,125 | 3/1938 | Von Bultzingslowen | 222/553 X |
| 2,682,358 | 6/1954 | Vitale | 222/553 X |
| 2,737,416 | 3/1956 | Behr et al. | 239/337 X |
| 3,063,602 | 11/1962 | Anderson | 222/553 X |
| 3,083,872 | 4/1963 | Meshberg | 239/337 X |
| 3,101,160 | 8/1963 | Picot | 239/337 X |
| 3,101,904 | 8/1963 | Prussin et al. | 239/337 |
| 3,141,579 | 7/1964 | Medlock | 222/553 X |
| 3,806,031 | 4/1974 | Olson | 239/288.3 X |

*Primary Examiner*—Andres Kashnikow
*Assistant Examiner*—Kevin P. Weldon
*Attorney, Agent, or Firm*—Andrew S. Langsam; Peter L. Berger

[57] ABSTRACT

A removable device for preventing air from drying the liquid of a spray can nozzle. A metal ring having a fibrous plug is pre-soaked in non-evaporative liquid. The plug surrounds and is in physical contact with the spray nozzle orifice to prevent air from entering the nozzle assembly.

7 Claims, 2 Drawing Sheets

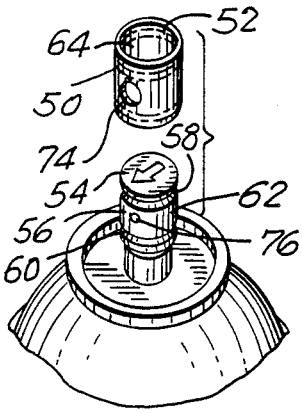
FIG. 5
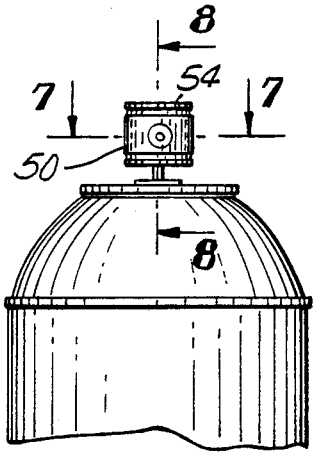
FIG. 6
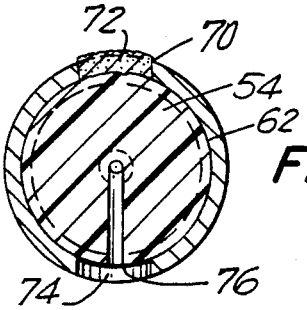
FIG. 7
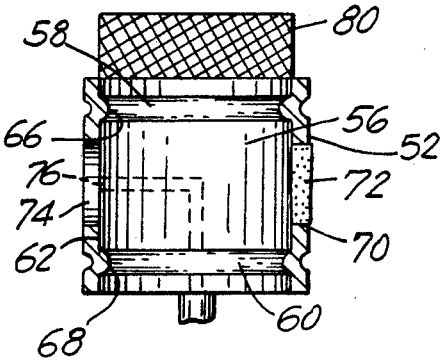
FIG. 8
FIG. 9
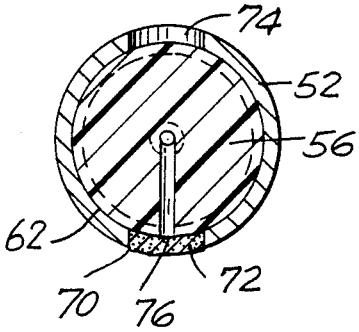

SPRAY CAN NOZZLE PROTECTOR

BACKGROUND OF THE INVENTION

The present invention relates to a device which is provided for use with a spray can nozzle assembly so that air is prevented from entering the orifice of the actuator of the spray can nozzle assembly. In this manner, the air cannot dry the fluid contents within the spray can nozzle assembly. The present invention is adapted to be used with spray cans containing pressurized paint or other air cured liquid material. The device of the present invention is adapted to be selectively removable and replaceable, as desired, so that it will be maintained over the actuator of the spray can nozzle assembly in its orificecovering position between uses of the spray can.

The present invention can also be adapted to be used with spray nozzles in professional use where paint supply is separate from the compressed air supply. Many formulations and colors of paint are available for use packaged in pressurized cans provided with contents dispensing spray nozzles. This type of dispensing actuator is an easy and effective method of applying paint to the area requiring protective or decorative coverage.

The main disadvantage of this system of paint dispensing is that, more often than not, the dispensing actuator orifice (even after following directions as to removing remaining paint by dispensing in inverted position until clean spray appears) is clogged with air dried materials the next time paint is to be dispensed. Thus, the present invention has general applicability to spray nozzles whenever it is desired to prevent the drying out of the fluid contained within the spray nozzle assembly by blocking off the orifice by use of a blocking pad, more fully explained hereinafter. In the preferred embodiment, as will also be explained, the blocking pad is a fibrous material soaked in oil which is substantially air impenetrable, non evaporating, and thus prevents air from drying out the paint contained within the spray nozzle assembly. The blocking pad when the device is secured to the nozzle assembly is immediately adjacent to and held against the orifice of the nozzle.

Spray cans containing paint are designed to dispense material by pushing, downwardly, on the nozzle assembly of the spray can. Between uses of the spray can, air has, in the past, been allowed to contact material still in the orifice of the actuator of the spray can nozzle assembly and thereby dry out the paint contents contained within the spray can orifice. It is thus highly desirable to provide a device which is capable of being selectively removed and replaceable over the orifice of the spray can nozzle assembly so that the orifice of the push button can be completely blocked off between uses to thereby prevent air from passing through to the orifice and drying out the paint contained within the spray can nozzle assembly. The present invention solves the desired purpose, as will be more fully explained hereinafter.

In an alternate embodiment of the invention a blocking pad soaked with the non-evaporative, air impenetrable substance is held against the dispensing orifice of a paint sprayer where the air pressure supply is separate from the paint reservoir. The knurled ring normally encircling the dispensing orifice is removed and replaced with a closed-end, knurled ring mounted on the spray nozzle assembly. The soaked pad is held in the closed end of the replacement knurled ring and when it is threaded onto the nozzle assembly the pad will cover the dispensing orifice.

DESCRIPTION OF THE PRIOR ART

As a result of a preliminary patentability search, the following U.S. patents were uncovered which are believed to be material to the present invention: U.S. Pat. Nos. 2,239,716; 2,310,319; 2,737,416; 3,3330,481; 3,702,668; 3,915,353 and 3,940,024.

The Behr reference, U.S. Pat. No. 2,737,416 discloses an unclogging closure cap for a spray dispenser. The closure cap incorporates a liquid absorbent sponge-like material which overlies the top of the push button and, in addition, surrounds a portion of the push button including the nozzle orifice. According to the specification of the Behr reference, the space enclosed by the cylindrical wall surrounding the push button is a fibrous liquid absorbent material, preferably a sponge which is adapted to absorb and retain a considerable amount of the liquid to thereby prevent hardening or drying of the liquid of the container in the nozzle orifice. Furthermore, the specification of the Behr reference indicates that the sponge or fibrous material can be saturated with a thinner for the paint so long as the material absorbs and retains the liquid. The present invention, on the other hand, provides a spray can nozzle air blocking device which holds a fiberous pad held against orifice that is saturated with a non-evaporative, air impenetrable material such as, for example, oil, mineral oil, motor oil or silicon oil; these substances do not tend to evaporate over time. The use of the present device prevents drying of the paint contained within the spray can nozzle assembly by blocking air from reaching within the confines of the nozzle assembly. This must be contrasted with the Behr teaching which provides that the material surrounding the orifice of the spray can nozzle be capable of absorbing liquid overspray originally contained within the spray can. The present invention is directed to preventing air from penetrating into the nozzle orifice to thereby prevent drying out or curling of the liquid material. Thus, the present invention represents an entirely different teaching from the Behr teaching although they are both directed to similar and related problems.

The Haas reference, U.S. Pat. No. 3,915,353 discloses an adaptor for use as an actuator for aerosol dispensers. The adaptor, in its preferred embodiment, consists of a short hollow cylindrical tube adapted to fit over the actuator button with the adaptor snugly engaging the outer wall of the button. This reference neither teaches nor suggests the invention disclosed herein relating to a device for preventing air penetration into the spray can nozzle assembly by use of a blocking pad which is soaked with an air impenetrable material, preferably, oil, the pad being immediately adjacent to the nozzle orifice.

The Russo et al. reference, U.S. Pat. No. 3,940,024 discloses an aerosol dispenser also incorporating an absorbent material strip 40 (see FIG. 2). The absorbent material strip is held in place by a carrier member (referred to in the specifications as element 50). The carrier member can be rotated until the absorbent strip is in registry with the hub and wall ports of the device. When the actuator or the push button is depressed the aerosol dispersant will be dispensed onto the absorbent strip. As evaporation proceeds, due to air circulating between the ribs, the deodorizer fluid is carried to the room for prolonged dispersion. Thus, this device is adapted to allow fluid deodorizer to permeate the room over a long time since the fluid is absorbed by the strip and the normal air circulation causes the deodorant to evaporate. Here, again, there is no teaching nor suggestion of the present invention.

U.S. Pat. No. 3,702,668 shows a safety device for an aerosol or similar dispensing container. The device utilizes two concentric tubular or cupped shaped parts having window openings which when put into registry achieve a first angular position and when taken out of registry achieve a second angular position. In order to operate the spray nozzle of the device to dispense fluid therefrom, it is necessary to perform a deliberate mechanical movement of the two parts with respect to one another to provide the proper registry of the window openings. In this manner, the device operates as a safety mechanism in that it is not believed that small children can perform the required manual manipulation to perform the registry of the window openings. This, however, neither teaches nor suggests the present invention relating to a mechanical device for blocking air penetration into a spray nozzle orifice assembly by use of a blocking pad soaked with an air impenetrable substance.

U.S. Pat. No. 3,330,481 relates to a spray can nozzle assembly which is adapted to provide a dispensing mechanism for the fluid contained within a pressurized can at a relatively uniform rate over a prolonged period of time. Specifically, the device disclosed therein is a cover adapted to fit over the valve end of the container. The cover has a central concave top. The push button of the can extends through an opening in the top of the cover. A plurality of radially disposed openings in the cover are provided and an absorbent strip material, housed within the cover, is placed behind the openings such that upon discharge of the fluid through the nozzle orifice, fluid will be sprayed onto and absorbed by the absorbent material. The evaporation of the fluid from the absorbent material allows for even dispersion of the fluid, over extended time, into the atmosphere. This, again, is quite distinct from the present invention wherein an air-blocking pad is provided for preventing air penetration through the nozzle orifice to thereby prevent drying out of the entire nozzle orifice assembly.

U.S. Pat. No. 2,310,319 relates to a nozzle spray device. A liquid absorbent fluid dispersing element is provided to the nozzle which is adapted to receive liquid through the conduit extending between the nozzle and the interior of the can. This absorbent material is intended to restrict the flow of pressure air through the head and to divert a portion of the pressure air through the conduit into the liquid reservoir. The absorbent material is not, however, intended to block exterior air from reaching the interior of the nozzle assembly to prevent drying out of the nozzle in the manner disclosed herein.

U.S. Pat. No. 2,239,716 also relates to a spray nozzle. Here, too, an absorbent fibrous material is provided in a removable manner to a can cap. Liquid absorbed by the fibrous material is intended to be ejected therefrom in a continuous fine spray by the use of a rubber handbulb 42. Here, again, the patent neither teaches nor suggests the use of an air impenetrable blocking pad which is adapted to the immediately adjacent to the nozzle orifice of the nozzle assembly to prevent air from passing through the orifice to thereby dry out the liquid contained within the air assembly.

SUMMARY OF THE INVENTION

The present invention relates to a selectively removable and replaceable blocking pad which is adapted for use in connection with a spray can nozzle assembly. The blocking pad is soaked with an air impenetrable solution as, for example, machine oil or silicon oil. In this manner, the blocking pad, when located immediately in contact to the nozzle orifice of the spray can nozzle assembly will thereby prevent air from penetrating into the nozzle assembly and prevents the liquid contained within the orifice from drying out within the nozzle assembly.

The preferred embodiment of the present invention contemplates that the air blocking pad be contained within a simple ring assembly which is to be used with paint spray cans such that the ring portion of the device slides over and is received by the exterior cylindrical surface of the spray can's actuator for the nozzle assembly. After purchase of a spray can, the ring having the air blocking pad is removed when it is desired to dispense the paint from the can. Subsequently, after the can is used, as desired, the air blocking pad and the metal ring is replaced over the actuator to prevent air from penetrating into the nozzle assembly so that the spray paint can be used, when desired, without concern that orifice will be blocked with dried paint.

As an alternative embodiment of the present invention, the non-evaporative, air-impenetrable blocking pad is removably secured to the front end of a spray nozzle assembly where the air pressure line is physically separate from the paint reservoir.

BRIEF DESCRIPTION OF THE DRAWINGS

FIG. 5 is a partial exploded perspective view of the top of a pressurized spray can, showing a second embodiment of the present invention;

FIG. 6 is a partial front plan view of the top portion of a spray can and showing the second embodiment of the present invention in its inoperative position, i.e., placed with the blocking pad turned to a position such that it does not cover the nozzle orifice and with the metallic ring encircling the actuator;

FIG. 7 is a cross-sectional view taken along lines 7—7 of FIG. 6 and again showing the device turned such that the hole of the device is registered with the nozzle orifice such that spraying can occur;

FIG. 8 is a cross-sectional view taken along lines 8—8 of FIG. 6 yet, again, showing the device in its inoperative position, i.e., in its paint spray mode, not the air blocking mode; and FIG. 9 is a cross-sectional view taken along the lines 7—7 of FIG. 6 yet showing the present device in its air blocking position.

DETAILED DESCRIPTION OF THE DRAWINGS

Figure 1:
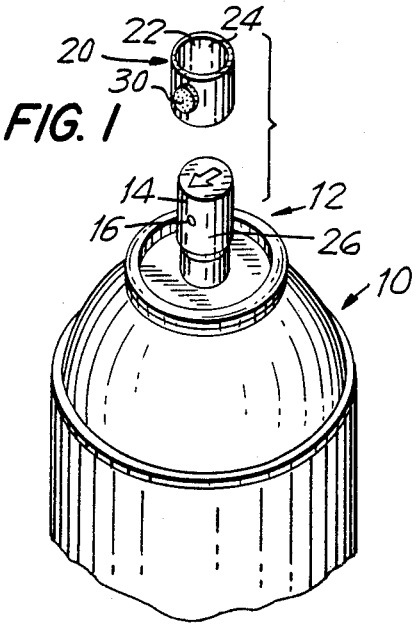
FIG. 1 is a partial exploded perspective view of the top portion of a conventional spray can, containing fluid, under pressure, and showing the present invention.

A pressurized spray can 10 is provided with a conventional spray can nozzle assembly 12 which includes a downward movement actuator 14 with a nozzle orifice 16. In a well known and conventional manner, depression of the actuator 14 against the force of a contained spring valve immediately below the dispensing actuator allows the pressurized fluid contained within the spray can to be selectively dispensed.

The present invention is a device for preventing the air drying or curing of fluid within the nozzle assembly between uses of the can. The device 20 generally comprises a metallic or plastic ring 22. The interior circumferential surface 24 of the metallic ring 22 is adapted to be slidably received around the exterior circumferential surface 26 of actuator 14. The metallic ring 22 is provided with a circular opening 28. The opening 28 is a hole through the sidewall of the metallic ring. An air blocking pad 30 of fibrous material saturated with non-evaporative material in the opening 28 and is adapted to be snugly contained and maintained therein. A portion of the blocking pad 30 extends beyond the interior circumferential surface 24 of the device 20 and, in addition, extends beyond the exterior wall surface of device 22.

The blocking pad 30 is preferably soaked with air impenetrable and non-evaporative solution as, for example, machine oil, mineral oil or a silicon-type oil. In operation, the device 20 is slidably mounted over the actuator 14 such that it is snugly maintained thereover with the blocking pad 30 directly adjacent to and, in fact, in contact with the nozzle orifice 16. In this manner, with the blocking pad 30 soaked, as mentioned, with machine oil, silicon or any other air impenetrable substance, air is prevented from entering into the spray can nozzle assembly 12 and, therefore, the liquid contained within the nozzle assembly and the tube extending from the bottom of the actuator into the can is prevented from drying out.

When it is desired to disperse the fluid contained within the spray can, then the device 20 can be simply removed and held while the user sprays the fluid from the can. Then, after the spraying operation is completed, and if the can still contains fluid which is intended and anticipated to be used at another time, the device 20 can, once again, be slidably received over the actuator 14 with the blocking pad 30 once again in close proximity and adjacent to and in contact with the nozzle orifice 16 so that, once again, the air impenetrable substance prevents air from entering into the nozzle orifice 16 of the nozzle assembly 12.

As best seen in FIGS. 5 through 9, a second embodiment of the invention contemplates that the device not be fully removable from the actuator. Thus the device cannot be accidentally misplaced. More specifically, a device 50 for preventing the air drying of fluid contained within a spray can nozzle assembly 56 comprises a metallic or plastic ring member 52. In this embodiment, however, the nozzle assembly 56 is specifically manufactured and constructed to accept and cooperate with the device 50. In this embodiment, the actuator 54 of the spray nozzle assembly 56 is provided with a pair of annular grooves 58 and 60 encircling around the exterior circumferential surface 62 of the actuator 54. The interior wall 64 of the device 50 is itself provided with a pair of vertically spaced yet interiorly directed annular ridges or bumps 66 and 68 (see FIG. 8). These ridges 66 and 68 are adapted to be received within and held by the grooves 58 and 60 of the actuator 54 when the device 50 is slid downwardly during manufacture, over the top of the actuator. In this manner, the device 50 cannot be accidentally removed and lost from the actuator 54 and, yet, the cooperation of the grooves 58 and 60 with the ridges 66 and 68 allows the device 50 to be selectively rotated with respect to the actuator 54.

Figure 2:
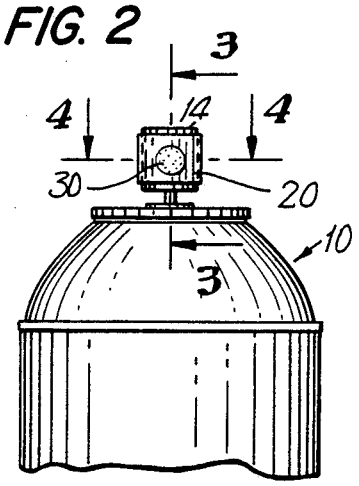
FIG. 2 is a partial front plan view of the top portion of a pressurized spray can and also showing the present invention in its operative position, i.e., when the blocking pad is placed over the actuator with the metallic ring of the present invention encircling the exterior circumference of the actuator and oil saturated pad covering the orifice.
Figure 3:
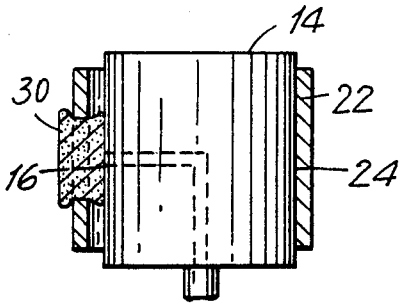
FIG. 3 is a cross-sectional view of the device of the present invention in operative positon over a nozzle assembly, namely an actuator taken along the lines 3—3 of FIG. 2.
Figure 4:
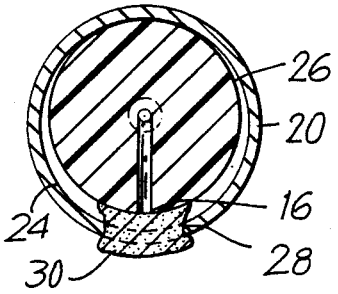
FIG. 4 is a cross-sectional view taken along lines 4—4 FIG. 2.

The device 50 is further provided, at one location of the ring member 52 with a hole 70. Again, similar to the first embodiment of the invention, shown in FIGS. 1 through 4, the hole 70 is adapted to fixedly receive and hold a blocking pad 72 (see FIGS. 7 and 9). This blocking pad is soaked and impregnated with a liquid as, for example, machine oil or silicon oil which serves to provide an air impenetrable barrier against the passage of air from the atmosphere into the nozzle assembly 56.

Located diametrically opposed from the hole 70 and blocking pad 72 is an aperture 74 (See FIG. 5) which, also, extends through the ring member 52. When it is desired to operate the actuator of the spray can, i.e., to release the fluid contained therein, the aperture 74 is aligned with the nozzle orifice 76 of the actuator 54 so that, upon depressing the actuator, the spray material can exit through the nozzle orifice 76 and then through aperture 74. When it is desired to store the spray can, then, the device 50 is rotated 180 degrees such that the blocking pad 72 is, once again, aligned with the nozzle orifice 76 to prevent the penetration of air into the nozzle assembly 56. Knurled extension 80 of the actuator 54 facilitates relative rotation of the device 50 with respect to actuator 54.

The cooperation of the annular ridges 66 and 68 and the annular grooves 58 and 60 serves to allow the device 50 to freely rotate about its central longitudinal axis so that a first position for blocking the nozzle orifice 76 can be achieved and, in addition, a second position with the aperture 74 in alignment with the nozzle orifice 76 can also be achieved, the latter being for dispersing fluid from within the spray can. FIG. 7 shows the alignment of the aperture 74 with the nozzle orifice 76 for allowing the fluid material contained within the can 10 to be freely dispersed while FIG. 9 shows the blocking pad 72 located immediately adjacent to and in contact with the nozzle orifice 76 such that air is prevented from penetrating into the nozzle assembly 56.

As an alternate embodiment of the present invention, the device can be used with a spray nozzle assembly wherein the fluid reservoir is physically separate from the air pressure supply lines. In this situation, a knurled threaded ring is used to secure the fluid dispensing orifice part, adjacent to air supply holes. After painting, the original knurled ring is removed and replaced by a closed-end ring which is threadably received on the same threads of the spray nozzle assembly formally used for holding the original knurled ring. Held within the inside of the closed-end ring, centrally located, is the air-blocking pad. Here, too, it is soaked with a non-evaporative, air-penetrable, oil-like substance. When the replacement ring is screwed onto the spray nozzle assembly, the air blocking pad will cover the dispensing orifice and prevent the fluid from drying out. It should be understood of course that the specific form of the invention herein illustrated and described is intended to be representative only as certain changes may be made therein without departing from the clear teachings of the disclosure. Accordingly, reference should be made to the following appended claims in determining the full scope of the invention.

I claim:

1. A device for preventing the air drying of fluid at a fluid discharge orifice of a conventional spray nozzle assembly, said device comprising:

a selectively removable and replaceable ring having a fibrous plug passing through the side wall of said ring, the diameter of said ring being only slightly larger than the diameter of the actuator of said spray nozzle assembly, said fibrous plug comprising an air blocking pad soaked in non-evaporative liquid which, when in use, is immediately adjacent to and substantially in contact with said fluid discharge orifice.

2. A device as claimed in claim 1, wherein said air blocking pad is substantially air impenetrable.

3. A device as claimed in claim 1, wherein said air blocking pad is soaked in oil.

4. A device as claimed in claim 1, wherein said air blocking pad is soaked in a silicon oil.

5. A device for preventing the air drying of fluid at a spray discharge orifice of a conventional spray nozzle assembly, said device comprising: a selectively removable and replaceable air blocking pad of fibrous material soaked with an air impenetrable and substantially non-evaporative substance which, when in use, is immediately adjacent to and substantially in contact with said fluid discharge orifice.

6. A device as claimed in claim 1, wherein said spray nozzle assembly is part of a spray can.

7. A device as claimed in claim 1, wherein said ring further includes an aperture through said side wall of said ring, and in which the interior wall of said ring has at least one annular ridge for facilitating selective rotating of said ring between positions, the ring being moveable to position either said aperture or said air blocking pad over said fluid discharge orifice.

* * * * *